US006247435B1

(12) United States Patent
Munz et al.

(10) Patent No.: US 6,247,435 B1
(45) Date of Patent: Jun. 19, 2001

(54) ARRANGEMENT FOR PROVIDING ELECTRICAL CONNECTIONS WITH AN ENGINE CONTROL UNIT

(75) Inventors: Dietmar Munz, Kernen; Wolfgang Renz, Stuttgart; Thomas Stolk, Kirchheim; Steffen Walter, Birenbach, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/442,311

(22) Filed: Nov. 22, 1999

(30) Foreign Application Priority Data

Nov. 26, 1998 (DE) ..... 198 54 542

(51) Int. Cl.[7] ..... F01M 9/10
(52) U.S. Cl. ..... 123/90.38; 123/143 C
(58) Field of Search ..... 123/143 C, 90.38

(56) References Cited

U.S. PATENT DOCUMENTS

| | | | | |
|---|---|---|---|---|
| 5,035,637 | * | 7/1991 | Mathews et al. | 123/90.38 |
| 5,390,648 | * | 2/1995 | Yanase | 123/634 |
| 5,642,704 | | 7/1997 | Gogots et al. . | |
| 5,746,168 | | 5/1998 | Lochbrunner et al. . | |
| 5,771,850 | * | 6/1998 | Okada | 123/143 C |

FOREIGN PATENT DOCUMENTS

| | | | |
|---|---|---|---|
| 42 25 359 | | 2/1993 | (DE) . |
| 42 25 358 | | 2/1994 | (DE) . |
| 197 19 299 | | 8/1998 | (DE) . |
| 197 56 095 | | 6/1999 | (DE) . |
| 197 56 342 | | 7/1999 | (DE) . |
| 0 602 398 | | 6/1994 | (EP) . |
| 0 798 450 | | 10/1997 | (EP) . |
| 0 869 261 | | 10/1998 | (EP) . |
| 10-252630 | * | 9/1998 | (JP) . |

* cited by examiner

*Primary Examiner*—Noah P. Kamen
(74) *Attorney, Agent, or Firm*—Klaus J. Bach

(57) ABSTRACT

In an arrangement for providing electrical connections between an engine control unit and electric power consumers disposed on a cylinder head of an internal combustion engine, particularly an electromagnetic valve control arrangement, wherein the cylinder head comprises a first housing part and a second housing part consisting of a frame structure mounted onto the first housing part. The second housing part includes electrical components with receptacles which are connected outside the second housing part to the engine control unit and the power consumers have communication lines provided with plugs plugged into the receptacles within the second housing part for electrical connection to the engine control unit. A cylinderhead cover is mounted onto the frame structure.

4 Claims, 2 Drawing Sheets

ARRANGEMENT FOR PROVIDING ELECTRICAL CONNECTIONS WITH AN ENGINE CONTROL UNIT

BACKGROUND OF THE INVENTION

The invention resides in an arrangement for providing electrical connections with an engine control unit for supplying power to consumers, particularly to the actuators of the electromagnetic valve control arrangements of an internal combustion engine.

DE 42 25 329 A1 discloses a structure for providing electrical connections between an engine control apparatus and the actuators of an electromagnetic valve control arrangement of an internal combustion engine. The internal combustion engine includes a cylinder head with intake and exhaust valves, which are operated by electromagnetic actuators. A cylinder head cover is mounted onto the cylinder head. The actuators include opening and closing magnets, which are energized by an engine control unit. For this purpose, each actuator is provided with a cable, which extends from the actuator within the cylinder head cover to an opening in the cylinder head cover through which cables pass for connection to the engine control unit.

This arrangement however has the disadvantage that, upon mounting the cylinder head cover, the cables, which are loosely disposed in the cylinder head cover could easily be squeezed between two portions being interconnected. Another disadvantage of this arrangement resides in the fact that it may result in sealing problems since, with the cables extending through the openings, there is the potential for leakages. Furthermore, the cylinder head cover must be sufficiently large to accommodate all the cables for the various actuators.

For general technical background information, reference is made to the older application DE 197 56 095.4.

It is the object of the present invention to provide an arrangement for providing electrical connections between electric power consumers and an engine control unit of an internal combustion engine, whereby space utilization is optimized and the assembly of the various parts is facilitated.

SUMMARY OF THE INVENTION

In an arrangement for providing electrical connections between an engine control unit and electric power consumers disposed on a cylinder head of an internal combustion engine, particularly an electromagnetic valve control arrangement, wherein the cylinder head comprises a first housing part and at least a second housing part mounted onto the first housing part, the second housing part is a frame structure which includes electrical components with receptacles. The receptacles are connected outside the second housing part to the engine control unit and the power consumers within the frame structure have communication lines provided with plugs plugged into the receptacles within the second housing part for electrical connection to the engine control unit.

It is particularly advantageous that, with the arrangement according to the invention space utilization is optimized and assembly is facilitated. The integration of the electrical components required for providing the connections, that is, the power end stages, the receptacles for the plugs on the electric consumer side, and the conductors interconnecting the power end stages and the receptacles in the terminal assembly of the cylinder head clearly facilitates the assembly since all the electric power consumers, particularly the actuators can be connected to the motor control unit before the mounting of the cylinder head cover onto the cylinder head without the need to pass the cables through the cylinder head cover. During assembly only the plugs of the cables extending from the electric power consumers need to be inserted into the receptacles of a terminal assembly at the frame structure. Preferably only a single cable extends from the terminal assembly to the engine control unit. During mounting of the cylinder head cover, it is therefore not necessary to take care that all the connections remain established and no cable is squeezed.

In addition, with the terminal assembly installed on the cylinder head, potential leakage of the cylinder head cover is avoided such leakage might occur with the penetration of the cables through the openings in the cylinder head cover. The plugs of the consumers are now inserted into the receptacles of the terminal assembly, which is connected to the engine control unit by a single main cable.

In addition, the integration of the electrical components into the terminal assembly results in an optimal space utilization. The electrical components integrated in the terminal assembly comprise all the elements needed for establishing connections between the electric energy consumers and the engine control unit, such as final power stages, receptacles and cables for the connections between the final power stages and the receptacles. In this way, the cables extending from the electric power consumers on the cylinder head and provided with plugs are plugged into the terminal assembly on the cylinder head. No cables extend through the cylinder head cover. As a result, a simple and space efficient arrangement is obtained. The terminal assembly may be provided with a seal disposed adjacent the cylinder head cover such that the need for a separate cylinder head cover seal is eliminated. Furthermore the connections are established by way of the terminal assembly and no cables extend through openings in the cylinder head cover and a seal structure is provided between the terminal assembly and. The cylinder head cover, the cylinder head cover is therefore acoustically uncoupled from the cylinder head preventing the transmission of vibrations and noises.

Further embodiments and advantages of the invention will become apparent from the following detailed description of the invention on the basis of the accompanying drawings.

DESCRIPTION OF A PREFERRED EMBODIMENT

Figure 1:
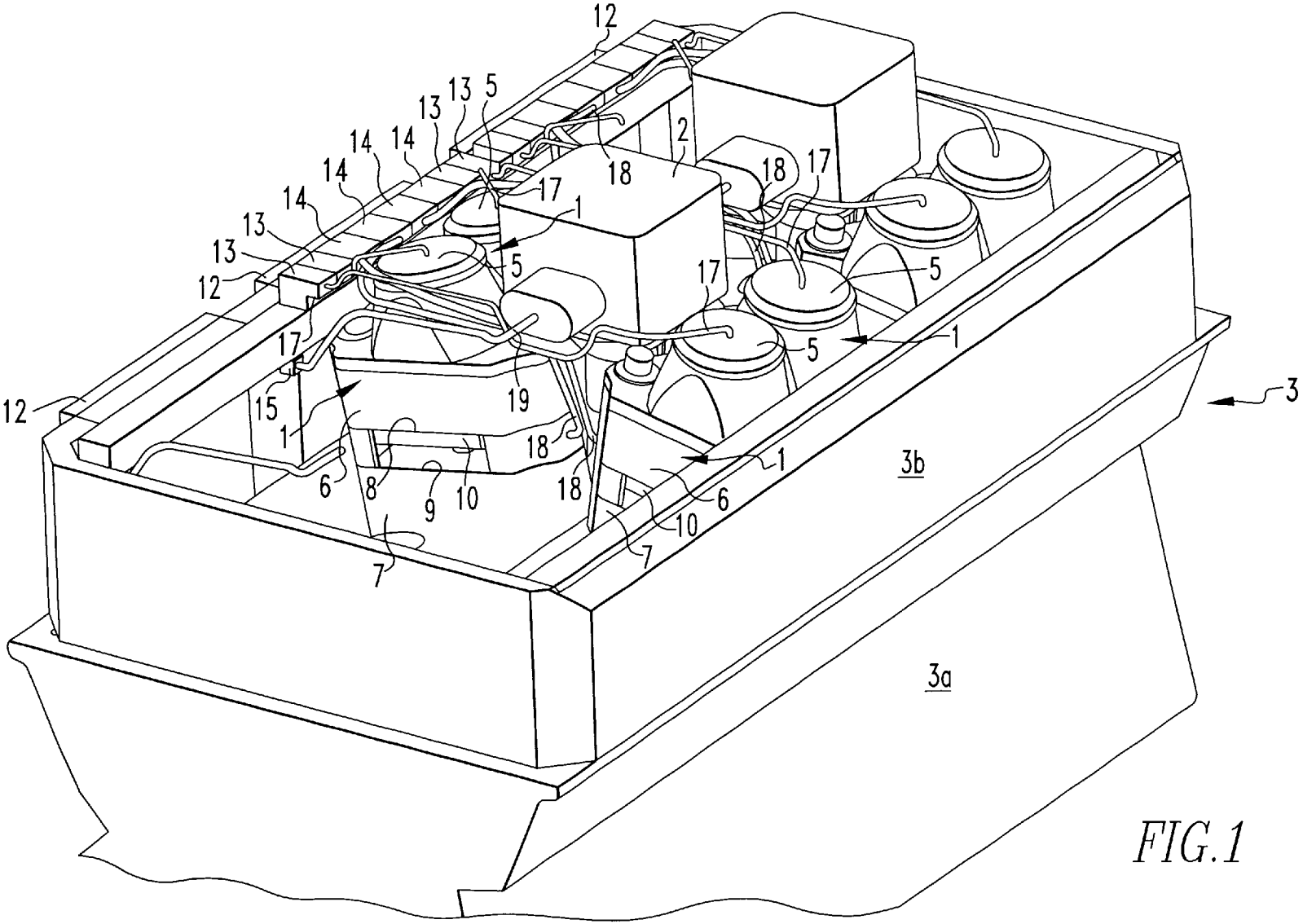
FIG. 1 shows a first embodiment of an arrangement for establishing electrical connections between an engine control unit and the ignition coils and the actuators of an electromagnetic valve operating mechanism of an internal combustion engine, wherein all electrical components are integrated in a terminal assembly mounted on the cylinder head of the internal combustion engine.

FIG. 1 shows a first embodiment of an arrangement for providing electrical connections between an engine control unit, which is not shown, and electrical power consumers of a multi-cylinder internal combustion engine. The consumers are particularly the actuators 1 of an electromagnetic valve control structure, which will be described below in greater detail, and the ignition coils 2. The three-cylinder internal combustion engine, which is not shown in full detail includes a cylinder head 3 consisting of three housing parts. The first housing part 3*a* comprises the basic cylinder head. The second housing part 3*b* is a frame structure mounted onto the basic cylinder head 3*a* and the third housing part resides in a cylinder head cover, which is to be mounted onto the frame portion 3*b* and which is well known and therefore omitted in the figure for clarity reasons.

The cylinder head 3 includes for each cylinder an ignition coil 2 and four gas exchange valves 4 (see FIG. 2), which control gas flow passages that are not visible. The gas exchange valves 4 (intake and exhaust valves) are controlled each by one actuator 1, which is also mounted on the cylinder head 3. The gas exchange valves 4 are disposed mostly in the first housing part that is the cylinder head 3*a*. The ignition coil 2 and the valve actuators 1 are arranged essentially within the second housing part 3*b* that is, the frame structure which is flanged onto the cylinder head and surrounds the valve operating mechanism. The third housing part, that is, the cylinder head cover is mounted onto the frame portion 3*b*.

Each actuator 1 includes a position sensor 5 for determining the position and/or movement of the gas exchange valve 4. It also includes two electrically controlled operating magnets 6, 7, that is a valve closing magnet 6 and a valve opening magnet 7, each having pole faces 8, 9. Between the pole faces 8, 9, there is an armature 10, which is connected to the gas change valve 4 so as to be movable therewith in the direction of the valve axis 11 (see FIG. 2). A spring arrangement, which is not visible in the figures but which comprises two pre-tensioned compression springs arranged in opposition to each other, forms, together with the gas exchange valve 4, a spring-mass-oscillation system. The system has a rest position between the two valve end positions, that is, the open and the closed end positions of the valve 4.

Out of this rest position, operation of the valve operating mechanism is initiated by the initial energization of the closing magnet 6 or the opening magnet 7, so that the armature 10 is attracted and moved to the respective end position against the return force of the elastic spring arrangement. Subsequently, the gas exchange valve 4 is actuated in that the operating magnet 6, 7 momentarily holding the armature is de-energized, whereby the gas exchange valve 4 is accelerated out of its respective end position toward its rest position. However, the valve 4 moves beyond its rest position toward the opposite operating magnet 7, 6 against the return force of the elastic spring arrangement. At this point the opposite operating magnet 7, 6 is energized to capture the armature and the valve 4 in the opposite end position.

Each cylinder is assigned a final power stage 12, which controls a consumer group including four actuators 1, four position sensors 5 and an ignition coil 2. The power end stages 12 and the associated receptacles for the actuator-side plugs 13, 14 and the ignition coil-side plug 15 are integrated into the frame part 3*b*. They are furthermore connected to the engine control unit either individually or commonly by a cable which extends from the frame part 3*b*, but which is not shown.

For the electric supply of an actuator 4 with an associated position sensor 5 seven lines are required which are combined in two plugs 13, 14. Three lines 17 are required for the position sensor 5 and four lines 18 are required for the operating magnets 6, 7. The lines 17 of the position sensor 5 terminate in a plug 13 and the lines 18 of the operating magnets 6, 7 of the actuator 1 terminate in a plug 14. For the power supply of the ignition coil 2, a line 19 with a plug 15 is provided. The receptacle for the ignition coil line plug 15 is also integrated into the frame part 3*b*.

For the connection of the engine control unit to the actuators 1 and the ignition coils 2 only the actuator-side plugs 13, 14 and the ignition coil-side plugs 15 must be inserted into the frame-structure receptacles. The final power stages 12 or, respectively, the frame structure 3*b* must be connected to the engine control unit. There are nine plug-in connections for each cylinder. Generally, an electric power supply also for other consumers arranged within the cylinder head cover such as pressure control valves or foot pedal position controllers may be provided by way of the frame structure 3*b*.

Figure 2:
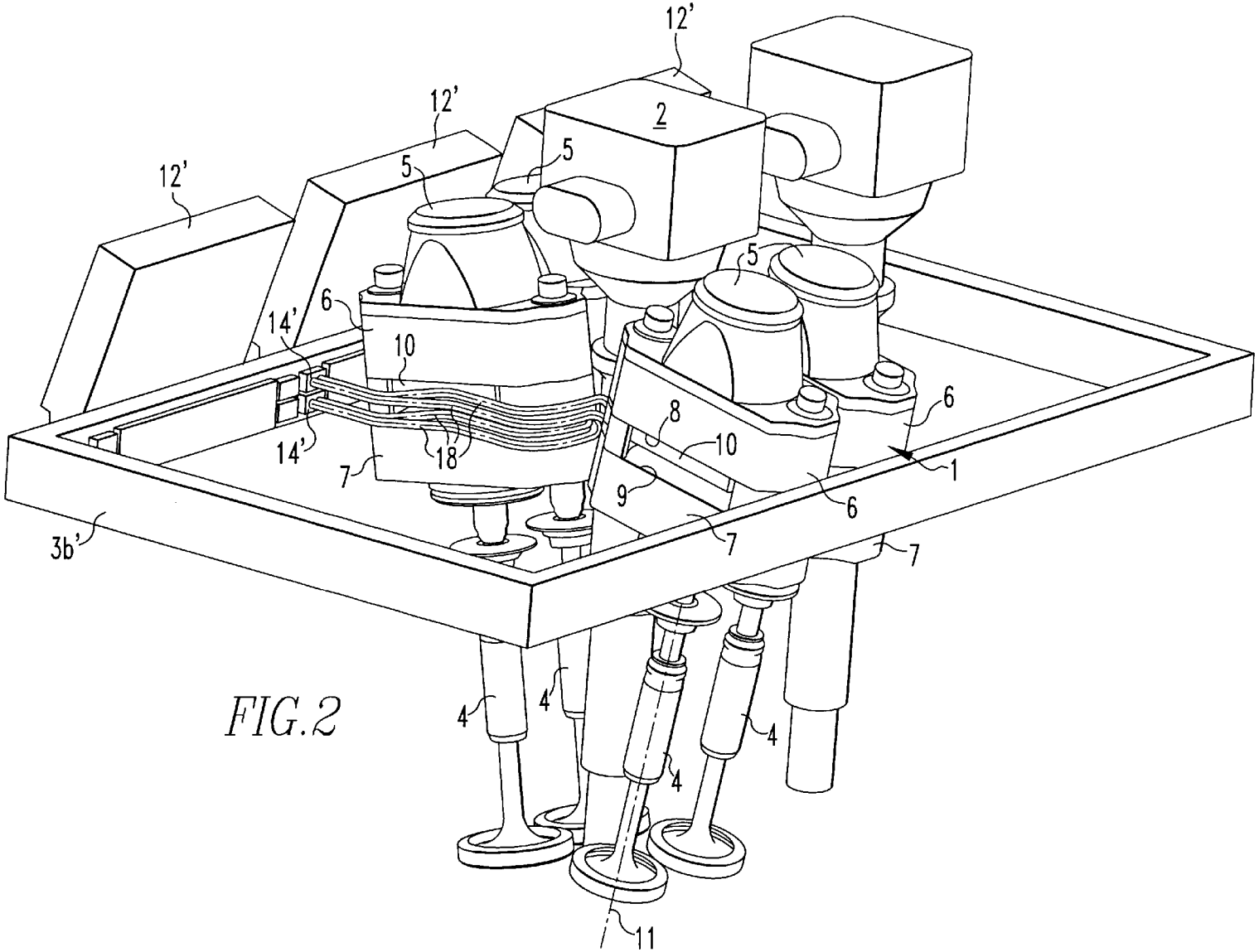
FIG. 2 shows a second embodiment, wherein only some of the electrical component are integrated in the terminal assembly.

FIG. 2 shows another embodiment of a connecting arrangement whose electrical components 12' are only partially integrated into the frame structure 3*b*'. The final power stages 12' are arranged at the frame structure 3*b*'. Only the lines which connect the final stages 12' with the receptacles for the electric power consumer-side plug 14' and the receptacles themselves are integrated into the frame structure 3*b*'.

The frame part may be provided with a seal strip at the side thereof adjacent the cylinder head and/or a seal strip at the side of the frame part adjacent the cylinder head cover.

What is claimed is:

1. An arrangement for providing electrical connections between an engine control unit and electric power consumers disposed on a cylinder head of an internal combustion engine, said cylinder head comprising a first housing part and a second housing part consisting of a frame structure arranged between the cylinder head and a cylinder head cover mounted onto said first housing part and adapted to carry a cylinderhead cover, said frame structure including electrical components with receptacles which are connected, outside said frame structure, to said engine control unit and said electric power consumers having communication lines provided with plugs plugged into said receptacles within said frame structure for electrical connection with said engine control unit, said communication lines and said receptacles being integrated into said frame structure and said final power end stages being attached to said frame structure.

2. An arrangement according to claim 1, wherein said electrical components include final power stages connected respective receptacles.

3. An arrangement according to claim 1, wherein said electrical components are at least partially integrated into said frame structure.

4. An arrangement according to claim 3, wherein said final power stages are connected to said engine control unit by at least one cable.

* * * * *